US005132139A

United States Patent [19]

Mecke et al.

[11] Patent Number: 5,132,139

[45] Date of Patent: Jul. 21, 1992

[54] THERMAL-PRINT RIBBON WITH THERMOPLASTIC MATRIX AND METHOD OF MAKING SAME

[75] Inventors: Norbert Mecke, Hanover; Albert Schmedes, Pattensen, both of Fed. Rep. of Germany

[73] Assignee: Pelikan Aktiengesellschaft, Hanover, Fed. Rep. of Germany

[21] Appl. No.: 537,633

[22] Filed: Jun. 13, 1990

Related U.S. Application Data

[63] Continuation of Ser. No. 234,970, Aug. 19, 1988, abandoned.

[30] Foreign Application Priority Data

Aug. 22, 1987 [DE] Fed. Rep. of Germany ..... 3728075

[51] Int. Cl.[5] ..... B41M 3/12

[52] U.S. Cl. ..... 427/146; 427/153

[58] Field of Search ..... 427/146, 153

[56] References Cited

U.S. PATENT DOCUMENTS 4,769,258 9/1988 Kobayashi et al. ..... 427/146

4,818,591 4/1989 Kitamuri et al. ..... 427/146

FOREIGN PATENT DOCUMENTS 3520308 12/1986 PCT Int'l Appl. .

2178553 2/1987 United Kingdom .

*Primary Examiner*—Janyce Bell

*Attorney, Agent, or Firm*—Herbert Dubno

[57] ABSTRACT

A thermal printing ribbon is made from an aqueous dispersion of a thermal plastic binder and particles of a wax component, fat-soluble dyestuff and a pigment so that these particles are found side by side in the interstices of a skeleton or matrix formed by a thermoplastic. The thermal printing ribbon has a multistrike capacity.

1 Claim, 1 Drawing Sheet

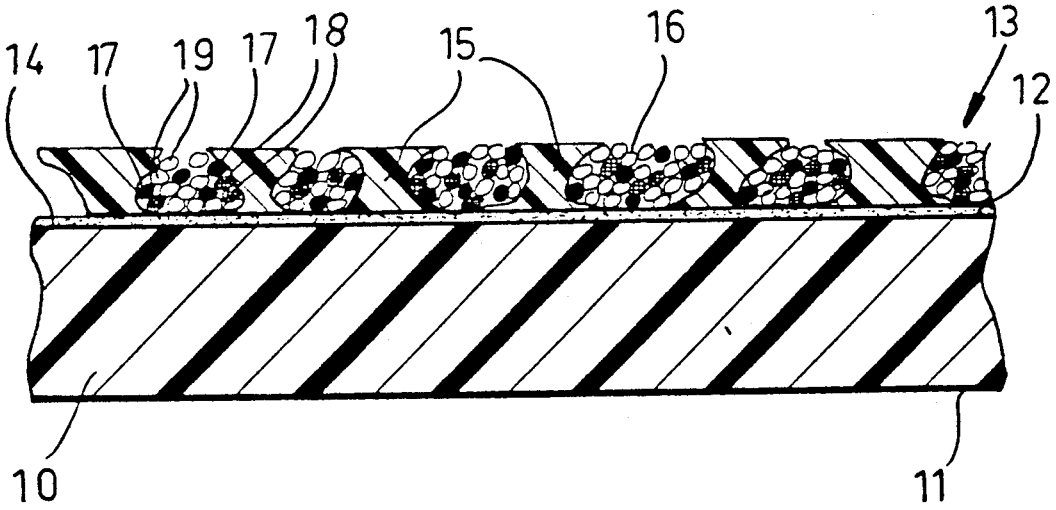
14
17
19
17
18
15
16
13
12
10
11

THERMAL-PRINT RIBBON WITH THERMOPLASTIC MATRIX AND METHOD OF MAKING SAME

This is a continuation of co-pending application Ser. No. 07/234,970 filed on Aug. 19, 1988, now abandoned.

CROSS REFERENCE TO RELATED APPLICATIONS

This application is related to the commonly owned copending applications Ser. No. 015,056 filed Feb. 5, 1987 (now U.S. Pat. No. 4,820,551 issued Apr. 11, 1989); Ser. No. 07/109,489 filed Oct. 15, 1987 Ser. No. 07/152,641 filed Feb. 5, 1988 and Ser. No. 07/154,651 filed Feb. 10, 1988.

Reference may also be had to the following commonly owned U.S. patents to which the aforementioned applications may be related in turn: Pat. No. 4,592,945 issued on Jun. 3, 1986; Pat. No. 4,675,063 issued on Jun. 23, 1987; Pat. No. 4,744,685 issued on May 17, 1988; Pat. No. 4,296,150 issued on Apr. 1 1980.

This application is also related to the concurrently filed copending application Ser. No. 07/234,969 filed Aug. 19, 1988 based on German application P 37 28 076.7 filed Aug. 22, 1987.

FIELD OF THE INVENTION

Our present invention relates to a method of making a thermal print ribbon for use in a thermal transfer printing process and was called, from time to time, a thermocolor ribbon or a thermocarbon ribbon. The invention also relates to a thermal print ribbon as made by the improved process.

BACKGROUND OF THE INVENTION

As will be apparent inter alia from the aforementioned copending applications and the related patents, the thermal printing process generally makes use of a ribbon having a support generally in the form of a carrier foil and a melt color layer applied to the transfer side of this foil.

The ribbon is displaced between a thermal printing head and a substrate adapted to receive the print and the printing head is activated to apply a head symbol or character, e.g. an alphanumeric symbol to the reverse of the ribbon and thereby melt over a corresponding pattern the melt layer on the obverse side and transfer the melted portion to the substrate. The substrate can be a sheet of paper which can be passed between the ribbon and a platen or other support.

The print head may utilize pins and the printing apparatus can be a dot matrix printer, or the symbol can be provided on a carrier such as a wheel, band or thimble.

Printers of this type can be integrated with keyboards or numeric pads, e.g. in office machines such as typewriters and calculators. They may also serve as printers connectable to computer or word processor terminals and the like.

By and large, the carrier foil is a plastic foil or fabric, similar to those used for carbon ribbons, while the melt color or transfer layer contains a wax and/or a waxlike substance, a dyestuff or other color agent and a thermoplastic binder together with optional additives.

Thermoprint ribbons of the aforedescribed type have, of course, long been known. Usually they make use of a foil-like carrier support which can be composed, for example, of paper or a synthetic resin, and a layer forming the transfer layer which constitutes the so-called melt color. The reference to a "melt color" is, naturally, merely shorthand for the statement that a fusible color layer can be melted onto a substrate to leave a portion of the fusible color layer on the substrate in the pattern of the head symbol applied to the back or reverse side of the ribbon.

It has already been mentioned that the fusible color layer will generally comprise a meltable wax-bound or synthetic resin bound dyestuff or carbon black layer.

As noted, the fusible color layer is melted by the hot printing head and a melted portion transferred to a substrate which can be a paper or foil.

The ribbons used heretofore in this manner have been termed thermotransfer or TCR ribbons, the latter acronym being short for "thermal carbon ribbon".

Thermal printers in which a hot symbol is printed in the manner described, have been the subject of German Printed Applications 2,062,494 and 2,406,613 as well as German Open Application 32 24 445.

In the operation of such printers, the printing head should generally be capable of developing a temperature which, at its maximum, will be about 400° C. The uncoated backside or reverse of the thermocolor ribbon, generally the reverse of the foil carrier, will come into direct contact with the printing head during the printing operation and, of course, the hot symbol.

At the instant of printing the relative speed between the thermocarbon and the paper or foil to receive the imprint is usually zero. Upon contact of the printing symbol with the ribbon, melting of the fusible color layer and contact of the melted portion thereof with the substrate paper or foil, a pattern of the color layer corresponding to the symbol will be transferred to the substrate. Upon detachment of the ribbon from the substrate, the previously melted material in the shape of the symbol will remain adherent to the substrate and will congeal.

Apart from the thermocolor ribbons described above with simple foil-like carriers, there are also thermocolor ribbons in which the hot symbol is not formed by a thermal printing head but by resistance heating of specially formed foil-like carriers. The melt color which is also the functional layer, during this printing process, also is transferred to a substrate in the desired pattern. In the trade, such ribbons are referred to as electrothermal ribbons and the process as an electrothermal transfer process (see U.S. Pat. No. 4,309,117)

Multiuse thermal transfer ribbons, i.e. thermal transfer ribbons capable of multistrike capacity, are described for example in EP-A-0 063 000. The fusible color layer of the ribbon here is in the form of a particulate material which is insoluble in the solvent of the coating liquid and does not melt at temperatures below 100° C. The coating liquid also contains a further particulate material with a melting point between 40° and 100° C. The particulate material which does not melt at temperatures below 100° C. is preferably a metal oxide, a metal, an organic resin or carbon black. Because of this special relationship of the particulate materials, the fusible color layer is a solid mixture with a heterogeneous structure designed so that at each printing strike, only a small amount of the fusible colored material is consumed by transfer to the substrate.

The conventional methods of making the abovementioned thermocolor ribbons possess, inter alia, the significant drawback that they make use of solvents which are released into the environment and are considered contaminants of the workplace or of the environment.

German Patent Document DE-OS 36 26 467 describes a process for thermal transfer in which the thermocolor ribbon does not require the use of an environment contaminating solvent.

However, the ribbon here is only a single strike ribbon and is not designed for multistrike or multiuse capability.

OBJECTS OF THE INVENTION

It is the principal object of the present invention to provide an improved process for making a thermal-transfer ribbon for the thermotransfer of a character to a substrate upon heating of the ribbon, whereby the abovementioned disadvantages are eliminated, a multistrike capacity is achieved and the need for working with environment contaminating solvents is eliminated.

Another object of this invention is to extend the principals of the commonly owned copending applications and patents detailed above so that a multistrike thermal-transfer ribbon can be produced without environmental contamination.

SUMMARY OF THE INVENTION

These objects and others which will become apparent hereinafter are attained, in accordance with the invention, by providing a thermotransfer ribbon capable of multiuse with multistrike capacity by providing the fusible melt-transfer layer on the obverse side of the foil with a thermoplastic binder which forms a matrix layer with interstices or a like skeletal structure, in the interstices, spacings or openings of which the particles of a fat-soluble dyestuff, particles of a wax or waxlike substance and particles of a pigment are disposed adjacent one another or side by side for release upon heating of the ribbon.

Specifically, the thermal-printing ribbon of the invention comprises:

- a carrier foil having a reverse side to which heat can be applied for thermal printing and an obverse side juxtaposable with the substrate; and
- a fusible color layer on said obverse side of the carrier for melt transfer to the substrate upon heating of the reverse side, the fusible color layer comprising:
  - a thermoplastic binder forming a matrix layer with interstices, and
  - particles of a fat-soluble dyestuff, a pigment and a wax component consisting of at least one wax or waxlike substance adjacent one another in the interstices.

The method of making the ribbon can make use of an aqueous dispersion with limited use of volatile organic solvents or absent such solvents. For example, the method can comprise the steps of:

(a) forming a substantially organic solventless aqueous dispersion of a fusible component consisting of at least one wax or waxlike substance, a thermoplastic binder and a fat-soluble dyestuff in finely divided form in the dispersion;

(b) coating the dispersion onto a thermotransfer side of a carrier foil; and (c) evaporating water from the dispersion coated onto the carrier foil to form a color-transfer layer from the dispersion coating on the foil.

BRIEF DESCRIPTION OF THE DRAWING

The above and other objects, features and advantages of our invention will become more readily apparent from the following description, reference being made to the accompanying highly diagrammatic drawing in which the sole Figure of which is a cross sectional view in highly diagrammatic and drawn to a very large scale, through a ribbon embodying the principles of the invention.

SPECIFIC DESCRIPTION

In the drawing, the synthetic resin foil carrier 10 is shown in a very greatly enlarged thickness to reflect the fact that the entire ribbon has been illustrated to an exaggeratedly large scale.

The carrier 10 has a reverse side 11 to which a heated symbol can be applied and an obverse side 12 the latter receiving the fusible color layer 13 which can be applied to an adhesion promoting layer 14 which is optional. The fusible layer 13 comprises a skeleton 15 of the the thermoplastic binder which has interstices 16, the latter being filled with particles. These particles include particles 17 of carbon black or a like pigment, particles 18 of fat-soluble dyestuff and of wax and/or a waxlike substance. The fusible color layer 13 is applicable to a substrate, e.g. of paper, to apply the molten wax component in which the dyestuff is solubilized upon melting and in which the pigment can be entrained, to the substrate for melt transfer thereto. In the interstices, of course, the several different types of particles are deposited in a side by side relationship.

We have discovered, quite surprisingly, that when the aqueous dispersion of the thermoplastic binder resin, the wax component consisting of at least one wax or waxlike substance, the fat-soluble dyestuff particles and the pigment particles is applied to the carrier or support and the water of the dispersion evaporated, the result is a skeletal matrix of the thermoplastic on the carrier which has interstices, pores or openings in which the particles of the wax component, the pigment and the fat-soluble dyestuff are lodged in side by side relationship so that, with use of the ribbon in a thermal printer, the transfer of heat through the foil will melt at least the wax component, cause solubilization of some of the dyestuff, and result in a transfer locally of a portion of the color layer to the substrate so that a multistrike capacity is developed for the ribbon.

For the purpose of the invention, any desired synthetic resin (plastic) foils can be used as the carriers, where such foils have been used heretofore as the carriers of carbon ribbons for typewriters and printers heretofore and which are also capable of withstanding the high temperatures during the brief printing processes which are necessary, for use of the ribbon of the invention as a thermal color ribbon. Of course, the carrier foil should also be capable, at these latter temperatures, of releasing the fusible color material. Preferred are the synthetic resin foils which are composed of thermoplastic synthetic resins having high transition temperatures.

The following materials have been found to be desirable: polyesters, especially polyethyleneterephthalate, polycarbonates, polyamides, polyvinyl compounds especially polyvinylchloride, polyvinylacetate, polyvinylalcohol and polyvinylpropionate, polyethylene, polypropylene and polystyrene. Preferably we make use of polyethyleneterephthalate or polycarbonate as carrier foils.

Of course, the invention can be applied to fabrics coated on one or both sides with plastics. Various composite foils are fabric, paper or plastic can also be used provided, of course, they have the properties enumerated above.

It has been found to be advantageous in some cases to incorporate a plasticizer in the plastic material forming the foil to improve the flexibility of the ribbon. It is also possible to incorporate in the material constituting the ribbon, one or more substances capable of increasing the thermal conductivity of the ribbon, e.g. metal particles. The thickness of the synthetic resin foil will generally depend upon the needs, although, as a rule, the foils can be comparatively thin, e.g. with a thickness of 3 to 6 micrometers so that an optimum heat transfer can be ensured. Of course, in this range is only preferred and use can be made of thicker of thinner foils as desired.

The term "wax" is used herein in the broadest possible sense and has been defined in the commonly owned copending applications and patents dealing with thermocarbon ribbons discussed above as well. In general, the wax should have the following characteristics:

It should be kneadable at 20° C. and should be solid to brittle-hard, coarse to fine crystalline and transparent to opaque but not glass-like.

It should be meltable at a temperature above 40° C. without decomposition and should substantially immediately above its melting point develop a comparatively lower viscosity and be non-ropy.

The term "waxlike substance" and terms of similar import should be understood to refer to the materials which have been described in the commonly owned copending applications and patents and waxlike substances and to have physical and chemical characteristics largely similar to those of the waxes as defined. In carrying out the method of the invention, it has been found that the wax or waxlike substances and the wax component constituted thereof, should preferably have a melting point of at least 70° C. and no more than about 95° C.

The aqueous coating dispersion contains the aforedescribed solid particles, i.e. the thermoplastic synthetic resin, the wax or waxlike substances, the fat-soluble dyestuff and, if desired, contain additives which do not adversely effect the transverse properties, including, for example, a pigment, preferably in a particle size between 0.5 and 100 micrometers, especially between approximately 5 and 50 micrometers. This particle size range assures an especially effective product.

The aqueous coating dispersion or suspension of these materials can be made in various ways. It can be made, for example, by suspending fine solid particles of these materials or by emulsification of the melt followed by cooling, preferably with stirring under conditions which maintain the finest possible dispersion.

An important component of the fusible layer formed in accordance with the invention is the thermoplastic binder or thermoplast. Thermoplasts are generally synthetic resins or plastics which at ambient temperature are hard or even somewhat brittle and, upon application of heat, reversibly soften and are mechanically easily deformable and at high temperatures can be transformed a viscous liquid state.

Such materials pass through softening or melting stages. In accordance with the present invention, such thermoplastic synthetic resins can be used which do not melt during the final thermal treatment or maximally soften. Bearing these conditions in mind, the ordinary skilled worker in the art can readily determine which thermoplastic binders will be suitable or can be used. We prefer to use, in this connection, polystyrene, polyvinylacetate, polyvinylacetal, polyvinylchloride, polyethylene, copolymers of vinylacetate and vinylchloride, polyvinylether, polyvinylpropionate, polyvirylacrylate or ethylene/vinylacetate copolymers.

The thermoplastic binder serves, in the fusible color layer of the invention, as a matrix substance in which the wax component, dyestuff and pigment are received. To control the hardness of this matrix substance in the final melt-transfer color layer, such conventional plasticizers for the thermoplastic binder can be added as phthalic acid esters (e.g. di-2-ethylhexylphthalate, diisononylphthalate and di-isodecylphthalate, aliphatic dicarboxylic acid esters such as adipic acid esters like di-2-ethylhexyladipate and di-isodecyladipate, phosphates such as tricresyl phosphate and triphenyl phosphate, fatty acid esters like triethylene glycol-2-(2-ethyl butyrate) and the like. It has been found to be advantageous in some cases to incorporate stabilizers in the thermoplastic binder.

The ratio of the wax component consisting of the wax or waxlike substance, to the thermoplastic binder in the aqueous coating dispersion can vary in fairly wide range and is largely not critical for the purposes of the invention. Preferably, however, this weight ratio is about 10:1 to about 1:5 and preferably the weight ratio is about 5:1 to 1:1.

The solids content of the coating dispersion or starting dispersion can likewise vary over relatively a wide range and can be, for example, between about 20 and 80 percent by weight, although it preferably is between substantially 30 to 60 percent by weight.

It is important for the purposes of the present invention that the dyestuff which is used be soluble in the wax or waxlike substance, i.e. in the wax component. This requirement is fulfilled by the so-called fat-soluble dyestuffs. This class of dyestuffs includes azo and anthraquinone dyestuffs, for example, those marketed by Bayer A.G. under the designation "CERES-Farbstoffe". Suitable dyestuffs in this category include, from Color Index part I, the following dyestuffs: Solvent Yellow 16, Solvent Yellow 29, Solvent Yellow 14, Solvent Red 1, Solvent Red 18, Solvent Red 25, Solvent Red 24, Solvent Red 19, Smoke Dye and Solvent Blue 63, Solvent Blue 68, Solvent Green, Solvent Brown 1, Solvent Red 3, Solvent Green 3 and Solvent Black 3. This list should not be considered as limiting, since other fat-soluble dyestuffs are known in the literature and, as long as they are soluble in the wax or waxlike substance and can transfer therewith by melt-transfer on thermal printing, can be used.

Apart from such dyestuffs, the fusible layer can include pigments like carbon black, organic and/or inorganic colored pigment and so-called fillers like chalk, china clay and kaolin or alumina.

Utilizing the principles of this invention, we can make use of a dispersion which in its liquid phase consists exclusively of water and thus, upon evaporation, will not present an environmental pollution problem. In that case, the liquid phase is free from other polar solvents and/or nonpolar organic solvents. It has been found, however, that no significant problem is posed when the aqueous medium contains small amounts of such solvents, for example, small amounts of ethanol. Naturally, in the best mode embodiment of the invention the liquid phase will be free from any other solvents.

The aqueous coating dispersion can be applied in any desired manner to the carrier. For example, it can be applied by a doctor blade. The coating technique used is not critical.

Furthermore, the water can be evaporated from the coating in any desired manner, e.g. by the treatment of the coating with hot air.

Preferably, however, the temperature during the water evaporation or water reduction stage (in which the water content of the coating is reduced) which is applied is only permitted to rise to a point below that at which the wax particles or the particles of the waxlike substance are not melted or subjected to a thermal treatment which will cause them to fuse together. One can operate at temperatures close to room temperature, if desired, although the process whereby air must be passed over the coating is thereby lengthened.

The layer thickness of the fusible color layer should be between about 5 and 30 micrometers, preferably between 10 to 20 micrometers, as the dry layer. It has been found to be advantageous in some cases to provide between the color layer and the carrier foil, an adhesion promoting layer, i.e. the layer 14, with a thickness of about 0.1 to 5 micrometers, preferably 0.5 to 2 micrometers. Such adhesion promoting layers can be composed of conventional polymeric materials.

SPECIFIC EXAMPLES

EXAMPLE 1

An aqueous dispersion is formed by intimately mixing the following components:

| | |
|---|---|
| Ethylene-Vinylacetate-Copolymer (about 35% water) (Ehaflex 5601/Akzo Chemie) | 15 parts by weight |
| Carbon Black (Regal 400 R/Cabot Corp.) | 2.5 parts by weight |
| Diazo Dyestuff-Solvent Red 18 (Ceresrot 3R/Bayer AG) | 0.1 parts by weight |
| Diazo Dyestuff Solvent Black 3 (Neozapon-Schwarz/BASF) | 0.9 parts by weight |
| Distilled Water | 2.5 parts by weight |
| Ethanol | 2.5 parts by weight |
| Defoamer for the aqueous dispersion (Additol VX W 4932/Hoechst AG) | 1 part by weight |
| Polyethylene Wax/Paraffin Dispersion (Südranol 340/Süddeutsche Emulsion Chemie) | 25 parts by weight |
| Polysiloxane (Organomodified) (Forbest G 23/Lukas Meier) | 0.1 parts by weight |

The aforedescribed dispersion is coated by a doctor blade, in a layer thickness corresponding to about 20 micrometers (after drying), onto a polyester support foil. The dispersion coating is dried by hot air at a temperature of 80° C. in a few minutes. The product is a thermoprinting ribbon capable of 8 overstrikes, i.e. a multiuse ribbon, each portion of which can transfer alphanumeric character to a substrate eight times.

EXAMPLE 2

A dispersion is formed with the following composition:

| | |
|---|---|
| Ethylene-Vinylacetate-Copolymer (About 40% water) (Ehaflex 222/Akzo Chemie) | 15 parts by weight |
| Painter's Clay (Colloid Clay Supreme/English China Clay Sales Co.) | 2.5 parts by weight |
| Ester Wax (Loxiol G 32/Henkel) | 10 parts by weight |
| Diazo Dyestuff-Solvent Red 18 (Ceresrot 3R/BAYER AG) | 0.1 parts by weight |
| Diazo Dyestuff-Solvent Black 3 (Neptun-Schwarz Black X60/BASF) | 0.9 parts by weight |
| Defoamer for the aqueous dispersion (Additol VX W 4932/Hoechst AG) | 1 part by weight |
| Polyethylene Wax/Paraffin Dispersion (Südranol 340/Süddeutsche Emulsion) | 25 parts by weight |

Using procedure described in Example 1, the emulsion is applied to a carrier foil. The resulting ribbon has similar qualities to those of the ribbon formed in Example 1.

EXAMPLE 3

An emulsion is formed with the following composition.

| | |
|---|---|
| Ethylene-Vinylacetate-Copolymer (about 40% water) (Ehaflex 222/Akzo Chemie) | 15 parts by weight |
| Ester Wax (containing amide groups) (Kahlwachs 2888 A/Kahlwachs & Co.) | 10 parts by weight |
| Painters Clay (Colloidal Clay Supreme/English China Clay Sales Co.) | 2.5 parts by weight |
| Diazo Dyestuff-Solvent Red 18 (Ceresrot 3R/BAYER AG) | 0.1 parts by weight |
| Distilled Water | 5 parts by weight |
| Diazo Dyestuff-Solvent Black 3 (Neptun-Schwarz X 60/BASF) | 0.9 parts by weight |
| Defoamer for the aqueous dispersion (Additol VX W 4932/Hoechst AG) | 1 part by weight |
| Polyethylene Wax/Paraffin Dispersion (Südranol 340/Süddeutsche Emulsion Chemie) | 25 parts by weight |

The dispersion is used to make a thermal printing ribbon with similar properties to that of Example 1 in the same way.

I claim:

1. A method of making a thermal-transfer ribbon for thermotransfer of a character to a substrate upon heating of said ribbon, said method comprising the steps of:
   (a) depositing an adhesion promoting layer onto a thermotransfer side of a carrier foil;
   (b) forming a substantially organic solventless aqueous dispersion of a fusible component consisting of at least one wax or waxlike substance, a thermoplastic binder and a fat-soluble dyestuff in finely divided form in the dispersion;
   (c) coating said dispersion onto said thermotransfer side of a carrier foil; and
   (d) evaporating water from the dispersion coated onto said carrier foil to form a color-transfer layer from the dispersion coating on said foil, and said coating step being the sole coating step after said adhesion promoting layer deposition step of said method.

* * * * *